US009042757B2

(12) United States Patent
Hirobe et al.

(10) Patent No.: US 9,042,757 B2
(45) Date of Patent: May 26, 2015

(54) IMAGE FORMING APPARATUS

(71) Applicant: CANON KABUSHIKI KAISHA, Tokyo (JP)

(72) Inventors: Fumitake Hirobe, Ushiku (JP); Shigeru Tanaka, Tokyo (JP); Akihiro Noguchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/182,515

(22) Filed: Feb. 18, 2014

(65) Prior Publication Data

US 2014/0255047 A1 Sep. 11, 2014

(30) Foreign Application Priority Data

Mar. 5, 2013 (JP) ..... 2013-043236

(51) Int. Cl.
*G03G 15/08* (2006.01)
*G03G 15/09* (2006.01)

(52) U.S. Cl.
CPC ..... *G03G 15/0824* (2013.01); *G03G 15/0893* (2013.01); *G03G 15/09* (2013.01); *G03G 2215/0838* (2013.01); *G03G 15/0849* (2013.01)

(58) Field of Classification Search
CPC ..... G03G 15/0849; G03G 15/0853; G03G 2215/0888
USPC ..... 399/59, 62, 63
See application file for complete search history.

(56) References Cited

U.S. PATENT DOCUMENTS

| | | | | |
|---|---|---|---|---|
| 5,819,132 | A | 10/1998 | Hirobe | |
| 6,173,133 | B1 * | 1/2001 | Donaldson et al. | 399/58 |
| 6,442,355 | B2 | 8/2002 | Hasegawa et al. | |
| 7,218,870 | B2 | 5/2007 | Hirobe | |
| 7,263,315 | B2 | 8/2007 | Tanaka et al. | |
| 7,349,653 | B2 | 3/2008 | Nishihama et al. | |
| 7,362,989 | B2 | 4/2008 | Nishihama et al. | |
| 7,386,261 | B2 | 6/2008 | Noguchi et al. | |
| 7,426,360 | B2 | 9/2008 | Arimoto et al. | |
| 7,881,638 | B2 | 2/2011 | Noguchi et al. | |
| 8,335,441 | B2 | 12/2012 | Kubo et al. | |
| 8,385,754 | B2 | 2/2013 | Hirobe et al. | |

(Continued)

FOREIGN PATENT DOCUMENTS

| | | | |
|---|---|---|---|
| JP | 05-289464 | A | 11/1993 |
| JP | 09-015963 | A | 1/1997 |

(Continued)

*Primary Examiner* — Gregory H Curran
(74) *Attorney, Agent, or Firm* — Fitzpatrick, Cella, Harper & Scinto

(57) ABSTRACT

A controller controls a replenishing operation of the first replenishing device based on the first sensor, and controls a replenishing operation of the second replenishing device based on the second sensor. The controller prohibits the replenishing operation of the first replenishing device when the developer concentration in the first replenishing device reaches a first upper limit set to the first developing device, and the controller prohibits the replenishing operation of the second replenishing device when the developer concentration in the second replenishing device reaches a second upper limit set to the second developing device. The controller corrects the second upper limit based on the developer concentration in the second developing device when the developer concentration in the first developing device reaches the first upper limit.

8 Claims, 6 Drawing Sheets

(56) References Cited

U.S. PATENT DOCUMENTS

| | | | | |
|---|---|---|---|---|
| 8,611,768 | B2 | 12/2013 | Kubo et al. | |
| 8,666,269 | B2 | 3/2014 | Tanaka | |
| 8,712,263 | B2 | 4/2014 | Tanaka | |
| 2009/0129796 | A1 * | 5/2009 | Ochiai | 399/43 |
| 2011/0280594 | A1 | 11/2011 | Tanaka | |
| 2012/0099900 | A1 | 4/2012 | Noguchi et al. | |
| 2013/0183049 | A1 | 7/2013 | Tanaka | |
| 2013/0230333 | A1 | 9/2013 | Hirobe | |
| 2013/0251387 | A1 | 9/2013 | Tanaka | |
| 2013/0287414 | A1 | 10/2013 | Tanaka | |
| 2014/0064749 | A1 | 3/2014 | Kubo et al. | |
| 2014/0119754 | A1 | 5/2014 | Tanaka | |

FOREIGN PATENT DOCUMENTS

| | | | |
|---|---|---|---|
| JP | 3088840 | B2 | 7/2000 |
| JP | 3262478 | B2 | 12/2001 |
| JP | 2008-020534 | A | 1/2008 |
| JP | 2012-003246 | A | 1/2012 |

* cited by examiner

FIG. 5A

REFLECTION DENSITY AT EACH LEVEL OF EACH COLOR

| LEVEL | 64 | 80 | 96 |
|---|---|---|---|
| Y | 0.200 | 0.232 | 0.317 |
| M | 0.215 | 0.271 | 0.316 |
| C | 0.191 | 0.256 | 0.298 |

FIG. 5B

Δh° IN RED (YELLOW + MAGENTA)

| Y\M | 64 | 80 | 96 |
|---|---|---|---|
| 64 | 0.52 | -2.15 | -6.68 |
| 80 | 3.97 | -0.28* | -3.20 |
| 96 | 5.38 | 2.99 | -0.48 |

FIG. 5C

Δh° IN BLUE (MAGENTA + CYAN)

| M\C | 64 | 80 | 96 |
|---|---|---|---|
| 64 | -0.06 | -2.34 | -6.41 |
| 80 | 3.77 | -0.17* | -2.25 |
| 96 | 7.34 | 4.31 | 1.47 |

FIG. 5D

Δh° IN GREEN (YELLOW + CYAN)

| Y\C | 64 | 80 | 96 |
|---|---|---|---|
| 64 | 1.30 | 6.7 | 9.86 |
| 80 | -2.95 | -0.01* | 4.61 |
| 96 | -5.76 | -4.31 | -0.19 |

IMAGE FORMING APPARATUS

BACKGROUND OF THE INVENTION

1. Field of the Invention

The present invention relates to an image forming apparatus which forms an image using an electrophotographic system, particularly to an image forming apparatus such as a copying machine, a printer, a facsimile machine, and a multifunction peripheral including plural functions thereof.

2. Description of the Related Art

Conventionally, in the image forming apparatus which forms a color image, there is a system in which toner images are formed using four color toners of yellow, magenta, cyan, and black and fixed while superposed. Generally, in some image forming apparatuses provided with the electrophotographic system, a two-component developer including a non-magnetic toner particle (toner) and a magnetic carrier particle (magnetic carrier) is used as a developer. Particularly, in the color image forming apparatus, the two-component developer is widely used for the reason that a shade is good because the magnetic material is not included in the toner.

In the color image forming apparatus, it is necessary to stabilize a color of an output. Therefore, for example, Japanese Patent Laid-Open Nos. 09-015963 and 05-289464 propose an attempt to stabilize the color of the output by stabilizing a density of each color.

In Japanese Patent Laid-Open No. 09-015963, a detector is used to detect the density of a test reference image (patch image) formed on an image bearing member. Another detector is used to detect a developer toner concentration in a developing container. A toner replenishing control system is switched based on detection results of the patch image density and developer toner concentration.

A development characteristic changes when a toner charge amount (triboluminence) changes by alteration of the magnetic carrier in the developer or an environmental fluctuation. Accordingly, a toner adhesion amount (that is, image density) of the patch image on the image bearing member indicates the development characteristic based on the change in toner charge amount. In order to guarantee the change in image density, developer toner concentration in the developing container is changed according to the change in toner adhesion amount, and control is performed such that the toner adhesion amount is kept constant.

However, in the case that toner replenishment decreases to significantly decrease the developer toner concentration as a result of the toner adhesion amount constant control, a coating amount decreases on a developing sleeve to lead to image degradation due to magnetic carrier adhesion. In the case that the toner replenishment increases to significantly increase the developer toner concentration, the developer overflows or the toner is transferred to a sheet white background part which should not originally be printed, which results in what is called an "image fog" in which the white background part gets dirty.

In Japanese Patent Laid-Open No. 09-015963, usually image density constant control is performed in order to guarantee the change in developer characteristic with the patch image density. As described above, in order to suppress runaway of the developer toner concentration in the developing container, the toner replenishing control system is switched in the case that the developer toner concentration in the developing container is greater than or equal to the predetermined range or less than or equal to the predetermined range.

In the technology of Japanese Patent Laid-Open No. 05-289464, using a detector which detects the test reference image (patch image) density formed on the image bearing member and a detector which detects the developer toner concentration in the developing container, a developing contrast potential is changed based on the results of the patch image density and developer toner concentration. At this point, the toner adhesion amount changes because toner charge amount changes by the alteration of the magnetic carrier in the developer or the environmental fluctuation. Therefore, the toner adhesion amount constant control is performed by changing the developer toner concentration in the developing container.

As to the problem in that the image density increases or decreases due to the developer toner concentration constant control, the change in image density is suppressed by increasing or decreasing the developing contrast potential.

In the shade stabilizing technologies of Japanese Patent Laid-Open Nos. 09-015963 and 05-289464, the color of the output is stabilized by stabilizing the color toner concentrations of yellow, magenta, cyan, and black. However, in the technologies, since a countermeasure is individually taken against the yellow, magenta, cyan, and black developing devices, sometimes a person recognizes the change in shade.

That is, when yellow, magenta, cyan, and black differ from one another in a tendency of the change in density, the person may recognize the "change in shade" even if the density of each color fluctuates slightly. This is because how the person feels the "change in shade" in a multiple order color such as secondary colors of red, blue, and green.

Specifically, in Japanese Patent Laid-Open Nos. 09-015963 and 05-289464, in order to suppress the change in toner adhesion amount (patch image density), the toner charge amount is kept constant by changing the developer toner concentration. This is the useful technology as the density stabilizing technology. However, as described above, it is necessary that the developer toner concentration fall within a certain range in order to prevent the overflow of the toner from the developing container, the image fog, and the magnetic carrier adhesion.

When the developer toner concentration exists outside the setting range, a transition is made to the developer toner concentration constant control. After the transition to the developer toner concentration constant control, sometimes the stability of the toner charge amount is lost to generate the change in image density. For example, in the case that the patch image density constant control is performed to cyan while the developer toner concentration constant control is performed to magenta, the person may feel the large change in shade of the image density in blue which is of the secondary color.

During the developer toner concentration constant control, the toner charge amount cannot be controlled because a mixture ratio (a ratio of a non-magnetic toner weight (T) to a total weight (D) of the magnetic carrier and non-magnetic toner, hereinafter referred to as a "T/D ratio") of the non-magnetic toner and magnetic carrier in the developing device is constantly controlled. On the other hand, during the patch image density constant control, the T/D ratio cannot be controlled because the toner charge amount is constantly controlled (that is, toner adhesion amount is constantly controlled). That is, the toner adhesion amount (that is, image density) varies during the developer toner concentration constant control, and the T/D ratio varies during the patch image density constant control.

Therefore, usually the two kinds of control are simultaneously performed with respect to the patch image density constant control in which the toner adhesion amounts of two colors vary slightly. For example, developer concentration constant control is performed to magenta while the patch image density constant control is performed to cyan. In this case, in forming image in blue which is of the secondary color, the variation in image density in magenta leads to the fluctuation in image density (color difference) in all the blue colors. Therefore, in the case that the image is viewed as the blue color, the person feels the change in shade by a density difference of magenta.

The shade will be described in detail. Generally the color is expressed by a color space such as L*a*b* and L*C*h° displayed in a polar coordinate in an a*b* plane. At this point, L* expresses lightness, C* expresses color saturation, and h° expresses a hue. It is said that the person easily recognizes the "change in shade" in the case that the hue h° changes.

The inventors made a simple experiment in order to verify a correspondence between the actual appearance of the secondary color and the hue h°. Half-tone images of yellow (Y), magenta (M), and cyan (C) were output with a full-color copying machine iRC3380 (manufactured by Canon Incorporated). The half-tone level was set to 64 level, 80 level, and 96 level in 0 to 255 levels.

A result in FIG. 5A was obtained when reflection densities of the samples were measured with a spectrophotometer 528JP (manufactured by X-Rite Incorporated).

Then nine kids of the red, blue, and green half-tone images in which two of the single half-tone colors were selected were output by combining the half-tone levels of three stages (64 level, 80 level, and 96 level) of each single color.

Based on the sample in which the single colors has the 80 and 80 levels, Δh° (a difference between h° of the reference sample and h° or a target sample) of the eight kinds of samples were measured with a spectrophotometer 528JP (manufactured by X-Rite Incorporated). FIGS. 5B to 5D illustrate the results.

In FIGS. 5B to 5D, a numerical value " . . . *" at the 80 and 80 levels means a measurement error, and the numerical value " . . . *" is originally zero.

In any secondary color, an absolute value of Δh° decreases in upper left and lower right directions in FIGS. 5B to 5D with respect to the sample at 80 and 80 levels, and the absolute value of Δh° increases in lower left and upper right directions, a vertical direction and a horizontal direction. That is, in the case that the density of one of the colors constituting the secondary color decreases (increases), compared with the case that the other color does not change, the change in hue (the absolute value of Δh°) decreases when the density of the other color decreases (increases).

The inventors actually compared the shade by the naked eye while the samples are two-dimensionally arrayed. As a result, as described above, the change in shade was hardly recognized in the upper left and lower right directions in which the absolute value of Δh° decreases, and the change in shade was prominent in other directions. That is, it is found that the value of the hue h° corresponds actually to the actual appearance of the secondary color.

The following items are found from the result. (1) In the case that the changes in density of the two colors constituting the secondary color are oriented in the directions opposite to each other (the lower left and upper right directions in FIGS. 5B to 5D), the change in hue (Δh°) increases, and the person recognizes the large change in shade. (2) The case that the densities of the two colors change in the identical direction (the upper left and lower right directions in FIGS. 5B to 5D) is better than the case that the density of one of the colors constituting the secondary color does not change while only the density of the other color changes (the vertical and horizontal directions in FIGS. 5B to 5D). In the case that the densities of the two colors change in the identical direction, the change in hue (Δh°) decreases, and the person hardly recognizes the change in shade.

That is, in the conventional technology, from the standpoint of the "change in hue in the multiple order color", since the colors are independently controlled, the person recognizes the change in shade by the change in hue h° even if the density of each color fluctuates slightly.

It is desirable to be able to effectively suppress the change in shade in the image forming apparatus which forms the color image using the plural colored toners.

SUMMARY OF THE INVENTION

According to one aspect of the present invention, an image forming apparatus comprising: a first developing device which stores a first developer therein to develop a latent image; a second developing device which stores a second developer therein to develop a latent image; a first replenishing device which replenishes the developer to the first developing device; a second replenishing device which replenishes the developer to the second developing device; a first sensor which detects a concentration of the developer in the first developing device; a second sensor which detects a concentration of the developer in the second developing device; and a controller which controls a replenishing operation of the first replenishing device based on the first sensor, and controls a replenishing operation of the second replenishing device based on the second sensor; wherein the controller prohibits the replenishing operation of the first replenishing device when the developer concentration in the first replenishing device reaches a first upper limit set to the first developing device; wherein the controller prohibits the replenishing operation of the second replenishing device when the developer concentration in the second replenishing device reaches a second upper limit set to the second developing device; and wherein the controller corrects the second upper limit based on the developer concentration in the second developing device when the developer concentration in the first developing device reaches the first upper limit.

According to another aspect of the present invention, an image forming apparatus comprising: a first developing device which stores a first developer therein to develop a latent image; a second developing device which stores a second developer therein to develop a latent image; a first replenishing device which replenishes the developer to the first developing device; a second replenishing device which replenishes the developer to the second developing device; a first sensor which detects a concentration of the developer in the first developing device; a second sensor which detects a concentration of the developer in the second developing device; and a controller which controls a replenishing operation of the first replenishing device based on the first sensor, and controls a replenishing operation of the second replenishing device based on the second sensor; wherein the controller forcedly performs the replenishing operation from the first replenishing device to the first developing device when the developer concentration in the first developing device reaches a first lower limit set to the first developing device; wherein the controller forcedly performs the replenishing operation from the second replenishing device to the second developing device when the developer concentration in the second developing device reaches a second lower limit set to the second developing device; and wherein the controller corrects the second lower limit based on the developer concentration in the second developing device when the developer concentration in the first developing device reaches the first lower limit.

Further features of the present invention will become apparent from the following description of exemplary embodiments with reference to the attached drawings.

BRIEF DESCRIPTION OF THE DRAWINGS

FIG. 5A is an example of a view illustrating a result in which reflection densities of yellow, magenta, and cyan samples are measured with a spectrophotometer 528JP (manufactured by X-Rite Incorporated);

FIG. 5B is an example of a view illustrating a result in which nine kinds of secondary color samples are output by combining red, blue, and green half-tone images in which two of single half-tone colors are selected with half-tone levels of three stages (64 level, 80 level, and 96 level) of each single color and measured with a spectrophotometer 528JP (manufactured by X-Rite Incorporated);

FIG. 5C is an example of a view illustrating a result in which nine kinds of secondary color samples are output by combining the red, blue, and green half-tone images in which two of single half-tone colors are selected with half-tone levels of three stages (64 level, 80 level, and 96 level) of each single color and measured with the spectrophotometer 528JP (manufactured by X-Rite Incorporated); and FIG. 5D is an example of a view illustrating a result in which the nine kinds of secondary color samples are output by combining the red, blue, and green half-tone images in which two of single half-tone colors are selected with the half-tone levels of three stages (64 level, 80 level, and 96 level) of each single color and measured with the spectrophotometer 528JP (manufactured by X-Rite Incorporated).

DESCRIPTION OF THE EMBODIMENTS

Hereinafter, an image forming apparatus according to an exemplary embodiment of the present invention will be described in detail with reference to the drawings.

[First Embodiment] A configuration of an image forming apparatus according to a first embodiment of the invention will be described below with reference to FIGS. 1 to 3.

Figure 1:
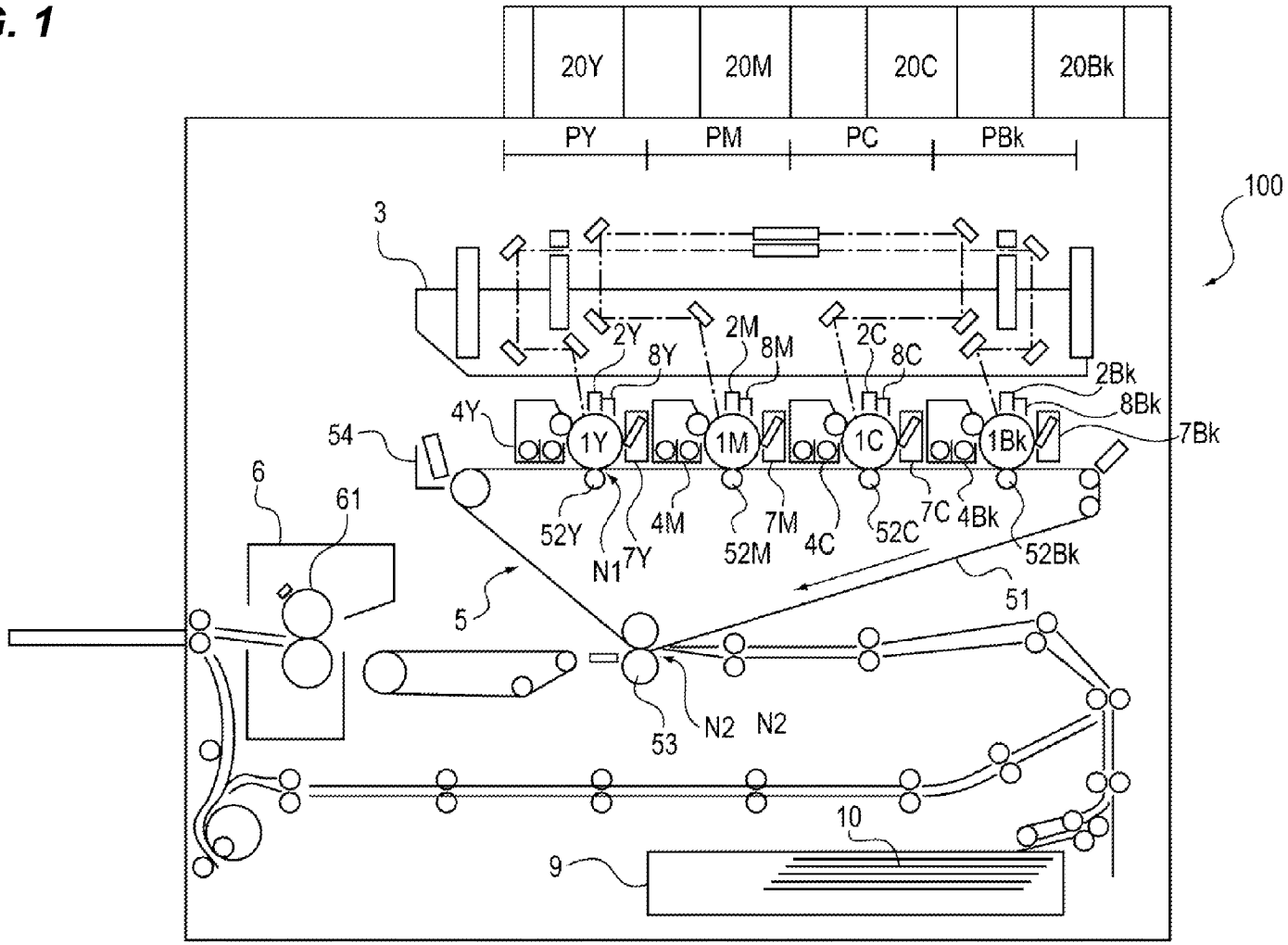
FIG. 1 is an example of a block diagram illustrating a configuration of an image forming apparatus according to a first embodiment of the present invention.
Figure 2:
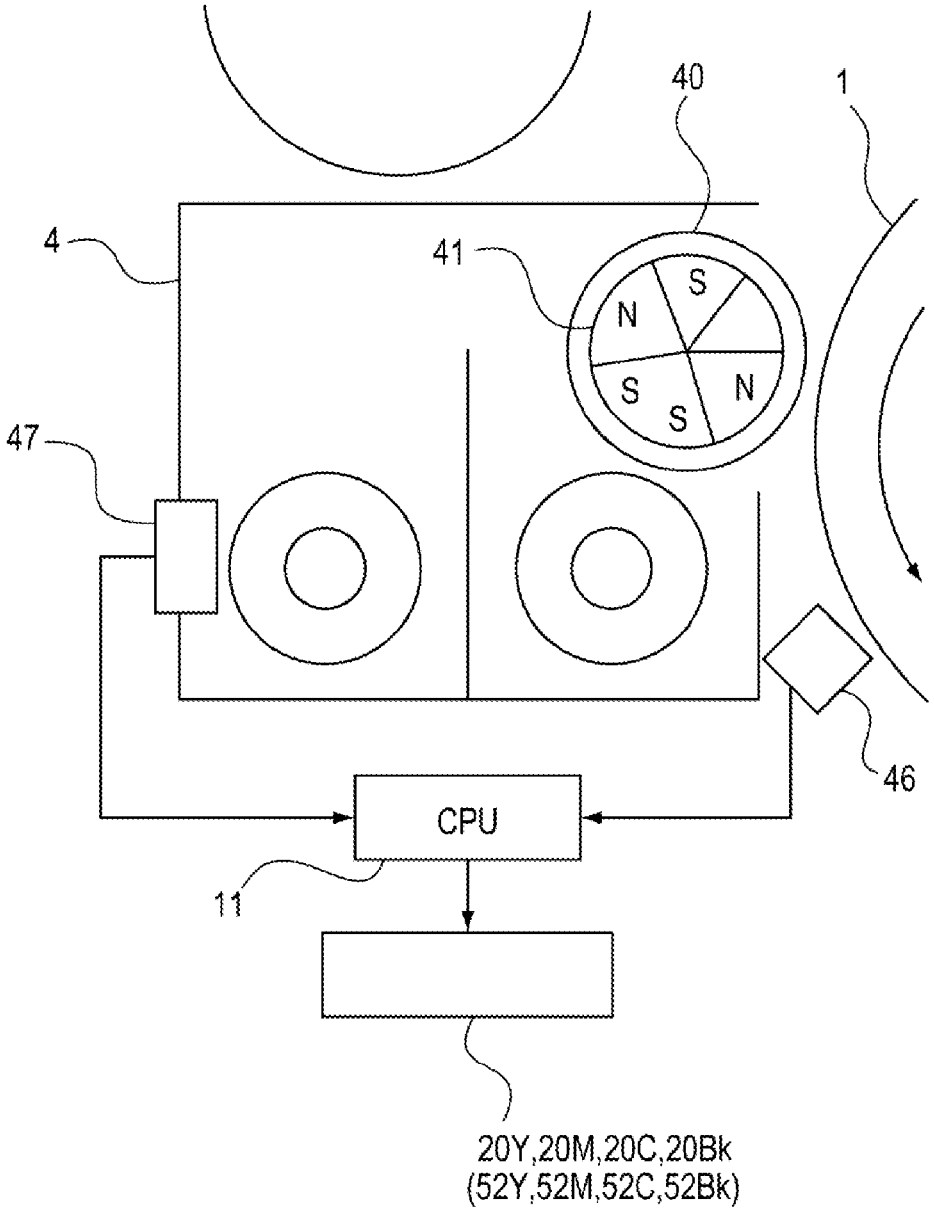
FIG. 2 is an example of a view illustrating a configuration of a surrounding of a developing device.
Figure 3:
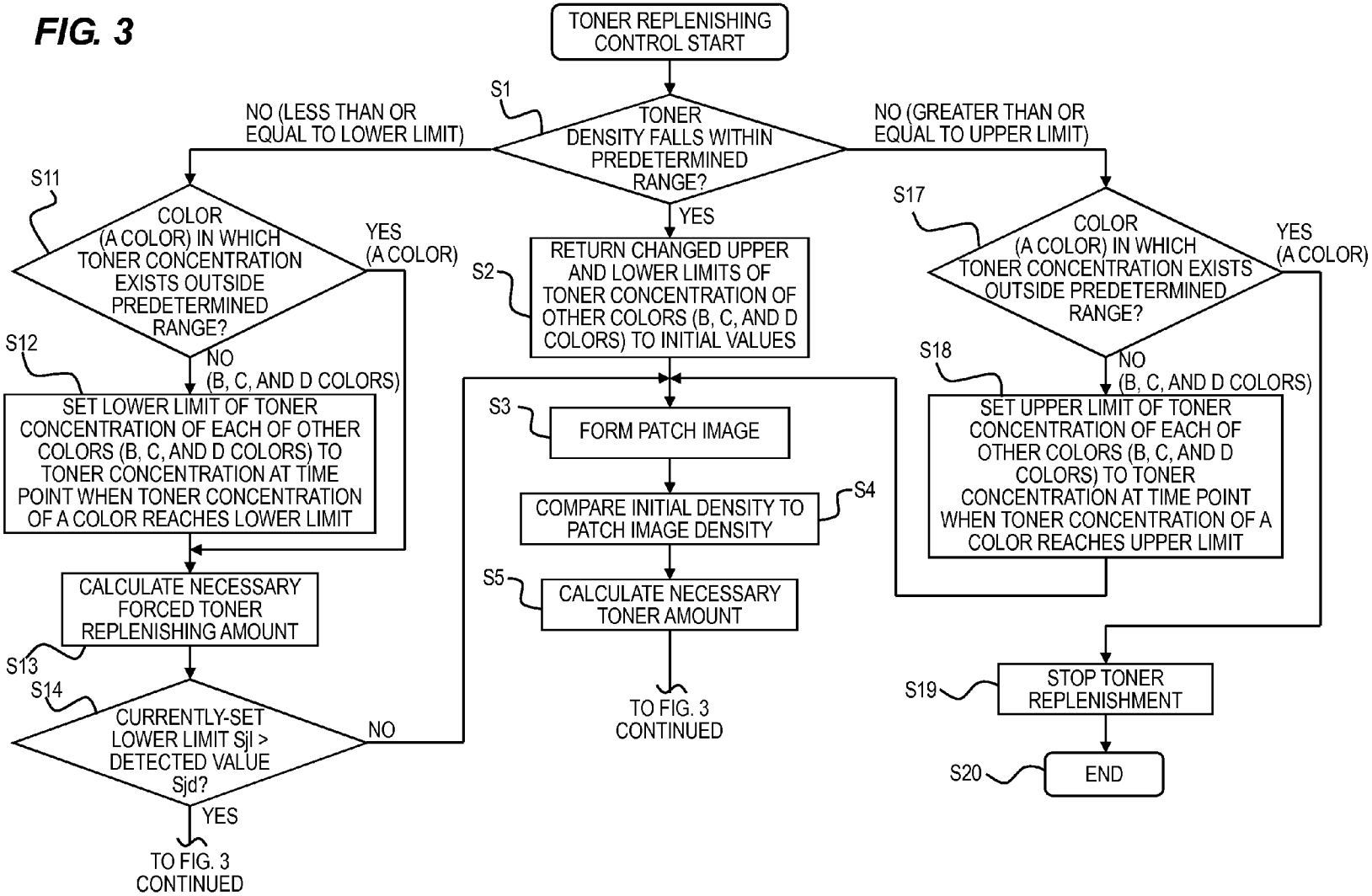
FIG. 3 is an example of a flowchart illustrating toner replenishing control in the image forming apparatus of the first embodiment of the invention.
Figure 3:
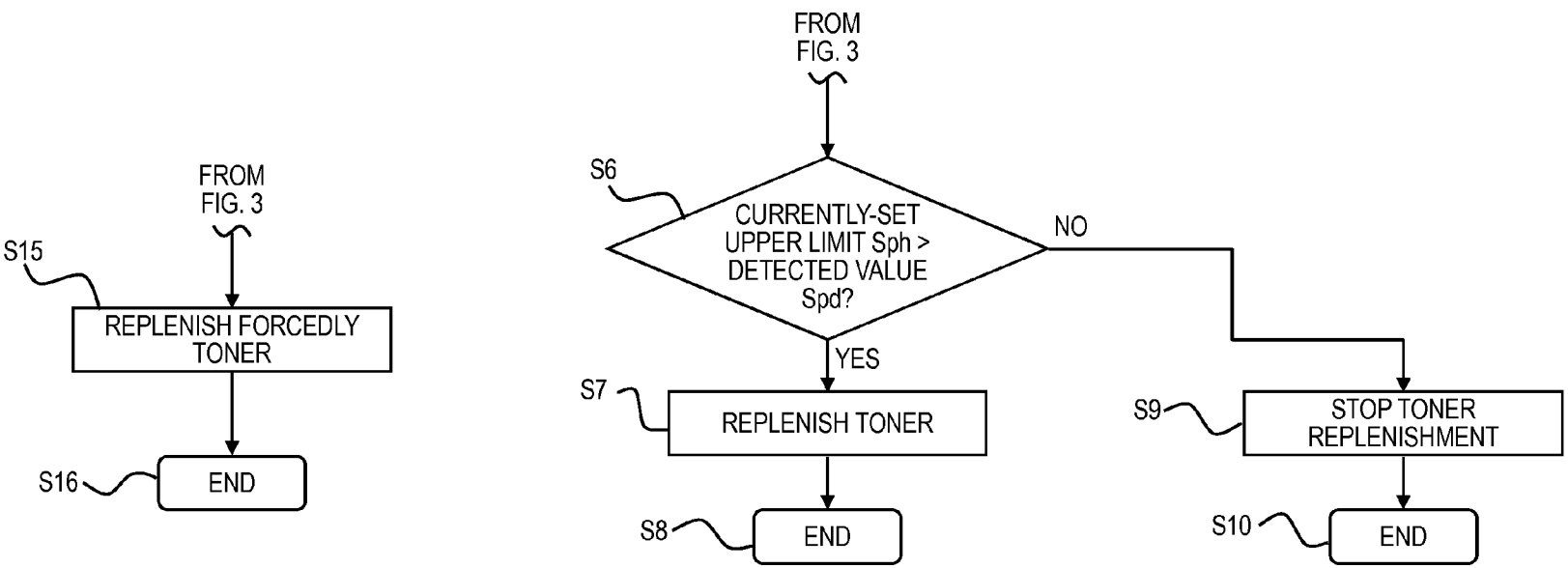

<Image forming apparatus> In FIGS. 1 to 3, an original reading device is connected to an apparatus body in an image forming apparatus 100. Alternatively, a host device such as a personal computer is communicably connected to the apparatus body. In the image forming apparatus 100, according to image information transmitted from these devices, a four-color full color image in yellow (Y), magenta (M), cyan (C), and black (Bk) can be formed on a recording material (such as a recording sheet, a plastic sheet, and a cloth) 10 using an electrophotographic system.

The image forming apparatus 100 of the first embodiment is a quadruple tandem type image forming apparatus, and includes first, second, third, and fourth image forming portions PY, PM, PC, and PBk which form yellow, magenta, cyan, and black images as plural image forming portions. While an intermediate transfer belt 51 included in a transfer device 5 moves in an arrow direction in FIG. 1 to pass through image forming portions PY to PBk, color images are superposed on the intermediate transfer belt 51 in the image forming portions PY to PBk. The multiple toner image superposed on the intermediate transfer belt 51 is transferred to the recording material 10 to obtain a recording image.

In the first embodiment, the configurations of the image forming portions PY to PBk are substantially identical to one another except a development color. Hereinafter, the four image forming portions PY, PM, PC, and PBk of yellow, magenta, cyan, and black are collectively referred to as an image forming portion P unless otherwise noted, and the same holds true for each related process portion.

The image forming portions PY to PBk include photosensitive drums 1Y, 1M, 1C, and 1Bk which are of the image bearing member on which an electrostatic image is formed. Charging devices 2Y, 2M, 2C, and 2Bk which are of the charging portion and an exposure device (in the first embodiment, a laser exposure optical system) 3, which is of the exposure portion are provided on an outer circumferences of the photosensitive drums 1Y to 1Bk. Developing devices 4Y, 4M, 4C, and 4Bk which are of the plural developing portions in which developers having different colors are stored and a transfer device 5 which is of the transfer portion are also provided. The developing devices 4Y, 4M, 4C, and 4Bk develop the electrostatic images formed on the photosensitive drums 1Y to 1Bk by forming toner images of plural colors.

Cleaning devices 7Y, 7M, 7C, and 7Bk which are of the cleaning portion and static eliminators 8Y, 8M, 8C, and 8Bk which are of the static eliminating portion are also provided. The transfer device 5 includes the intermediate transfer belt 51 which is of the intermediate transfer member. The intermediate transfer belt 51 is entrained about plural rollers to rotate in the arrow direction (go around) in FIG. 1. Primary transfer members 52Y, 52M, 52C, and 52Bk are disposed cross the photosensitive drums 1Y to 1Bk from the intermediate transfer belt 51. A secondary transfer member 53 is provided at a position opposed to one of the rollers about which the intermediate transfer belt 51 is entrained.

During the image formation, surfaces of the rotating photosensitive drums 1Y to 1Bk are evenly charged by the charging devices 2Y to 2Bk. Then the charged surfaces of the photosensitive drums 1Y to 1Bk is scanned and exposed with the exposure device 3 in response to an image information signal, thereby forming the electrostatic images on the photosensitive drums 1Y to 1Bk. The developing devices 4Y to 4Bk develop the electrostatic images formed on the photosensitive drums 1Y to 1Bk as the toner images using toner which is of the developer. At this point, hoppers 20Y, 20M, 20C, and 20Bk, which are of the replenishing portion which replenishes the color toners to the developing devices 4Y to 4Bk according to consumed toner amounts, supply the color toners to the developing devices 4Y to 4Bk.

The toner images formed on the photosensitive drums 1Y to 1Bk are primarily transferred onto the intermediate transfer belt 51 in primary transfer nip parts N1 in which the intermediate transfer belt 51 abuts on the photosensitive drums 1Y to 1Bk. The toner images formed on the photosensitive drums 1Y to 1Bk are primarily transferred onto the intermediate transfer belt 51 by an effect of a primary transfer bias voltage applied to the primary transfer members 52Y to 52Bk. For example, during the four-color full color image, the toner images are sequentially transferred onto the intermediate transfer belt 51 from the photosensitive drums 1Y to 1Bk from the first image forming portion PY, and the multiple toner image in which the four color toner images are superposed is formed on the intermediate transfer belt 51.

On the other hand, the recording material 10 is stored in a sheet cassette 9 which is of the recording material storage portion. In synchronization with the toner image on the intermediate transfer belt 51, the recording material 10 is conveyed to a secondary transfer nip part N2 in which the intermediate transfer belt 51 abuts on the secondary transfer member 53 by the recording material conveying member such as a pick-up roller, a conveying roller, and a registration roller. In the secondary transfer nip part N2, the multiple toner image on the intermediate transfer belt 51 is transferred onto the recording material 10 by an effect of a secondary transfer bias voltage applied to the secondary transfer member 53.

Then the recording material 10 separated from the intermediate transfer belt 51 is conveyed to a fixing device 6. Using the fixing device 6, the toner image transferred onto the recording material 10 is fixed onto the recording material 10 while melted and mixed by heating and pressurization. Then the recording material 10 is discharged to the outside of the apparatus.

Adhesive materials, such as the toner, which remain on the photosensitive drums 1Y to 1Bk after a primary transfer process, are recovered by cleaning devices 7Y to 7Bk. The electrostatic images remaining on the photosensitive drums 1Y to 1Bk are erased by static eliminators 8Y to 8Bk. Therefore, the photosensitive drums 1Y to 1Bk are ready for a next image forming process. The adhesive materials, such as the toner, which remain on the intermediate transfer belt 51 after a secondary transfer process are removed by an intermediate transfer member cleaner 54.

<Developing device> The developing devices 4Y to 4Bk of the first embodiment will be described in detail. Referring to FIG. 2, a two-component developer including a non-magnetic toner and a magnetic carrier of each color is stored in the developing device 4. A developing sleeve 40 is made of a non-magnetic material. The developing sleeve 40 constitutes the rotatable developer bearing member including a fixed magnet 41 which is of the magnetic field generator.

The two-component developer in the developing device 4 is conveyed to a development region while retained in layers. The two-component developer is supplied to the development region opposed to the photosensitive drum 1. The two-component developer is circulated in the developing device 4 while stirred by a stirring member. The toner is stirred and frictioned with the surface of the magnetic carrier, thereby having a predetermined charge amount.

In order to improve development efficiency, namely, a toner imparting ratio to the electrostatic image on the photosensitive drum 1, a developing bias voltage generator (not illustrated) applies a developing bias voltage in which an AC voltage is superimposed on a DC voltage to the developing sleeve 40.

<Two-component developer> The two-component developer will be described below. The toner includes a colored resin particle including a binder resin, a colorant, and another additive as needed and a colored particle to which an external additive such as a colloidal silica fine powder is externally added. The toner is made of a negatively-charged polyester resin, and a volume average particle diameter can range from 5 μm to 8 μm the first embodiment, the toner had the volume average particle diameter of 7.0 μm.

Examples of the magnetic carrier include metals, such as iron, nickel, cobalt, manganese, chromium, and a rare earth metal, in which the surface is oxidized or unoxidized, and alloys thereof and ferrite. There is no particular limitation to a method of producing the magnetic particles. The magnetic carrier has the volume average particle diameter of 20 μm to 50 μm preferably of 30 μm to 40 μm and has a resistivity of $1\times10^7$ Ωcm or more, preferably of $1\times10^8$ Ωcm or more. In the first embodiment, the magnetic carrier had the volume average particle diameter of 40 μm, the resistivity of $5\times10^7$ Ωcm, and a magnetization quantity of 260 emu/cc.

The volume average particle diameter of the toner of the first embodiment was measured by the following device and method. A Coulter counter TA-II (manufactured by Beckman Coulter, Inc.) and an interface (manufactured by Nikkaki-Bios) which output a number average distribution and a volume average distribution were used as a measuring device. A 1% NaCl aqueous solution prepared using primary sodium chloride was used as an electrolytic aqueous solution.

The measuring method is as follows. A surfactant, preferably alkylbenzene sulfonate of 0.1 ml as a dispersant and a measurement sample of 0.5 mg to 50 mg were added into the electrolytic aqueous solution of 100 ml to 150 ml. The electrolytic aqueous solution in which the measurement sample is suspended was subjected to dispersion treatment for about 1 minute to about 3 minutes with an ultrasonic dispensing device. Then the distribution of the particles having the particle sizes of 2 μm to 40 μm was measured to obtain the volume average distribution by the Coulter counter TA-II using an aperture of 100 μm. Therefore, the volume average particle diameter was obtained from the volume average distribution.

Using a sandwich type cell having a measuring electrode area of 4 $cm^2$ and a distance between electrodes of 0.4 cm, an applied voltage E (V/cm) was applied between the electrodes while one of the electrodes was pressurized with a weight of 1 kg, and the resistivity of the magnetic carrier was obtained from a current passed through a circuit.

A permeability detection sensor 47 which is of the developer concentration detecting portion is provided in the developing device 4 (in developing portion). In the permeability detection sensor 47, a developer toner concentration (a weight ratio of the toner in the two-component developer) is detected by detecting a permeability of the two-component developer. A toner adhesion amount detection sensor 46 is provided between the developing device 4 and the primary transfer member 52 on a downstream side of the developing sleeve 40 of the developing device 4 in a rotating direction of the photosensitive drum 1.

The toner adhesion amount detection sensor 46 is the image density detecting portion, which forms a density detecting reference image (hereinafter referred to as a "patch image") on the photosensitive drum 1 and detects the toner adhesion amount on the patch image. The toner adhesion amount detection sensor 46 and the permeability detection sensor 47 are configured as the characteristic detector which detects a characteristic value of each color developers.

<Toner concentration detection principle> A toner concentration detection principle of the permeability detection sensor 47 will be described below. The magnetic carrier included in the two-component developer has the permeability. The apparent permeability increases when only the toner is consumed in the developing device 4 during the development. The apparent permeability decreases as only the toner is replenished in the developing device 4 to increase the toner amount in the magnetic carrier.

Thus, in the two-component development system, a mixture ratio (a ratio of a non-magnetic toner weight (T) to a total weight (D) of the magnetic carrier and the non-magnetic toner, hereinafter referred to as a "T/D ratio") of the non-magnetic toner and magnetic carrier changes in the developing device 4. As a result, a toner charge amount changes to change a development characteristic, thereby changing an output image density.

The permeability detection sensor 47 decreases a detection signal value, because the apparent permeability decreases as the T/D ratio of the developer increases (the toner ratio increases) in the developing device 4. Accordingly, in the case that the permeability detection sensor 47 increases the detection signal value, the toner amount is determined to be decreased, and the toner is replenished.

Based on a detection result of the permeability detection sensor 47, a CPU (Central Processing Unit) 11 which is of the controller controls a replenishing operation of the hopper 20 such that the developer concentration in the developing device 4 does not exceed a predetermined upper limit Sjh and such that the developer concentration in the developing device 4 does not sink below a predetermined lower limit Sjl.

<Patch image density detection principle> On the other hand, because a regular reflection optical sensor is used in the toner adhesion amount detection sensor 46 which is of the image density detecting portion detecting the toner adhesion amount on the patch image, the toner adhesion amount detection sensor 46 increases the detection signal value when the patch image density is high. Accordingly, in the case that the toner adhesion amount detection sensor 46 decreases the detection signal value, the toner amount is determined to be decreased, and the toner is replenished.

Based on a detection result of the permeability detection sensor 47, the CPU 11 which is of the controller determines whether the developer toner concentration exists outside a predetermined range in at least one of the developing devices 4Y to 4Bk which is of the plural developing portions. In the case that the developer toner concentration exists outside the predetermined range in the developing device 4, the CPU 11 controls a toner replenishing operation with respect to the developing device 4 in which the developer toner concentration exists outside the predetermined range based on the detection result of the permeability detection sensor 47.

The CPU 11 controls the toner replenishing operation based on the detection signals of the toner adhesion amount detection sensor 46 and the permeability detection sensor 47. The CPU 11 calculates a toner replenishing amount based on the detection signals of the toner adhesion amount detection sensor 46 and the permeability detection sensor 47. The CPU 11 stabilizes the output image density by replenishing the color toners into the developing devices 4Y to 4Bk from the hoppers 20Y, 20M, 20C, and 20Bk that are of the replenishing portion.

<Toner replenishing control> The toner replenishing control will be described below with reference to FIG. 3. The detection of the toner concentration range from Step 1 in FIG. 3 and the density control based on the detection are always performed during the image forming operation.

In Step S1 of FIG. 3, the permeability detection sensor 47 detects the developer toner concentrations of the developing devices 4Y to 4Bk during the usual image forming operation. The CPU 11 determines whether the developer toner concentration falls within the predetermined range between the upper limit Sjh and the lower limit Sjl of the previously-set T/D ratio. For example, in the initial developer toner concentration, when each color developer having the T/D ratio of 8% is used, the upper limit Sjh of the T/D ratio is set to 12% and the lower limit Sjl of the T/D ratio is set to 6%.

In the case that the developer toner concentration detected by the permeability detection sensor 47 falls within the predetermined range in Step S1, the flow goes to Step S2. In Step S2, sometimes the upper limit Sjh and lower limit Sjl of the T/D ratio previously set as the initial value in each color are changed as described later. In such cases, the upper limit Sjh and lower limit Sjl of the T/D ratio, which are of the toner concentrations of changed other colors (for example, B, C, and D colors), are returned to the initial values (the initial upper limit and the initial lower limit).

In the case that the developer concentration sinks below the previously-set upper limit Sjh in the developing device 4 in which the developer concentration reaches the upper limit Sjh, the CPU 11 returns the upper limit Sjh of the developer concentration in the developing device 4 in which the upper limit Sjh is changed to the previously-set initial upper limit Sjh. In the case that the developer concentration exceeds the previously-set lower limit Sjl in the developing device 4 in which the developer concentration reaches the lower limit Sjl, the CPU 11 returns the lower limit Sjl of the developer concentration in the developing device 4 in which the upper limit Sjh is changed to the previously-set initial lower limit Sjl.

The CPU 11 performs patch image density constant control such that the T/D ratio which is of the toner concentration falls within the range between the upper limit Sjh and the lower limit Sjl.

The patch images which are of the image density detecting reference images are formed on the photosensitive drums 1Y to 1Bk in predetermined timing (Step S3). The patch electrostatic images corresponding to a predetermined density (for example, the initial density is set to "0.8") are formed as the patch images on the photosensitive drums 1Y to 1Bk, and developed by the developing devices 4Y to 4Bk.

The patch image formed by the toner image is irradiated with light emitted from an LED (Light Emitting Diode) of the toner adhesion amount detection sensor 46, and the light reflected from the patch image is received by a receiving portion such as a photoelectric conversion element. Therefore, the toner adhesion amount detection sensor 46 detects a patch image density detection signal value Spd indicating the actual patch image density currently formed on each of the photosensitive drums 1Y to 1Bk.

A difference between the patch image density detection signal value Spd detected by the toner adhesion amount detection sensor 46 and a patch image density reference signal value Spi corresponding to a previously-set specified value (initial density) of the patch image is calculated (Step S4). Assuming that ΔSp is the difference between the patch image density signal values during the change of developer toner concentration by 1%, and that T is the toner amount for the developer toner concentration of 1%, the toner amount necessary to return to the initial density is calculated using Formula 1 (Step S5).

$$\text{toner replenishing amount}=\{(Spi-Spd)/\Delta Sp\}\times T \qquad \text{[Formula 1]}$$

In Formula 1, {(Spi−Spd)/ΔSp} indicates how many percent of the change in developer toner concentration is equivalent to the difference between the patch image density detection signal value Spd and the patch image density reference signal value Spi. The patch image density detection signal value Spd is the actual patch image density currently detected by the toner adhesion amount detection sensor 46. The patch image density reference signal value Spi is the signal value corresponding to the specified density of the patch image. The necessary toner amount is calculated by multiplying {(Spi−Spd)/ΔSp} by the toner amount T for the developer toner concentration of 1%. The patch image density reference signal value Spi corresponding to the specified density of the patch image is stored as a backup value of the image forming apparatus 100 in the CPU 11 during exchange of the developer.

In Step S6, the currently-set patch image density upper limit signal value Sph and the current patch image density detection signal value Spd are compared to each other. In the case of {Sph>Spd}, the currently actual patch image density is determined not to reach the currently-set upper limit of the patch image density. The flow goes to Step S7, and each of the developing devices 4Y to 4Bk is replenished from the hoppers 20Y to 20Bk by the toner replenishing amount calculated from Formula 1. Then the toner replenishing control is ended (Step S8).

In the case of {Sph≤Spd} in Step S6, the currently actual patch image density is determined to reach or exceed the currently-set upper limit of the patch image density. The flow goes to Step S9 to stop the toner replenishment to each of the developing devices 4Y to 4Bk. Then the toner replenishing control is ended (Step S10). That is, the control is performed through Steps S3 to S10 such that the patch image density becomes the initial density.

On the other hand, in the case that a value Sjd in which the currently actual permeability detection signal value detected by the permeability detection sensor 47 in each of the developers of the developing devices 4Y to 4Bk is converted into the T/D ratio reaches the previously-set lower limit Sjl of the predetermined T/D ratio in Step S1, the flow goes to Step S11. In the case that the value Sjd reaches the previously-set upper limit Sjh of the predetermined T/D ratio in Step S1, the flow goes to Step S17.

(The case that developer toner concentration of A color reaches lower limit) For the developing devices 4 of other colors (B, C, and D colors) except the color (A color) in which the T/D ratio (toner concentration) reaches the lower limit Sjl (exists outside of the predetermined range) in Step S11, the flow goes to Step S12. The lower limits Sjl of the T/D ratios of other colors (B, C, and D colors), which are detected when the A color in which the T/D ratio reaches the lower limit Sjl is detected are changed as the new lower limit Sjl.

For the developing device 4 of the A color in which the T/D ratio reaches the lower limit Sjl in Step S11, the flow goes to Step S13. In Step S13, the necessary forced toner replenishing amount is calculated using Formula 2.

The forced toner replenishing amount necessary for the developing device 4 of the A color in which the T/D ratio reaches the lower limit Sjl is the necessary toner amount until the value Sjd in which the currently actual permeability detection signal value detected by the permeability detection sensor 47 in the developer of the developing device 4 of the A color is converted into the T/D ratio reaches the previously-set lower limit Sjl of the predetermined T/D ratio in the case that the value Sjd sinks below the previously-set lower limit Sjl of the predetermined T/D ratio.

In Formula 2, ΔSj expresses a value in which a permeability signal value difference during the change in developer toner concentration by 1% is converted into the T/D ratio, and T expresses the toner amount for the developer toner concentration of 1%.

$$\text{necessary forced toner replenishing amount}=\{(Sjl-Sjd)/\Delta Sj\}\times T \quad \text{[Formula 2]}$$

In Formula 2, {(Sjl−Sjd)/ΔSj} indicates that the difference between the value Sjd in which the currently actual permeability detection signal value is converted into the T/D ratio and the previously-set lower limit Sjl of the T/D ratio is equivalent to how many percent of the developer toner concentration is changed.

The necessary toner amount, which should be replenished until the currently actual T/D ratio sinking below the lower limit Sjl of the T/D ratio reaches the lower limit Sjl of the T/D ratio, is calculated by multiplying {(Sjl−Sjd)/ΔSj} by the toner amount T for the developer toner concentration of 1%.

The previously-set lower limit Sjl and upper limit Sjh of the T/D ratio are stored in the CPU 11 as the backup value of the image forming apparatus 100.

On the other hand, for the developing devices 4 of other colors (B, C, and D colors), the developer toner concentrations of the developing devices of other colors at a time point when the developing device of the A color reaches the lower limit of the developer toner concentration is set as the lower limit (Step S12). The forced toner replenishing amounts necessary for the developing devices 4 of other colors (B, C, and D colors) is as follows.

The value Sjd in which the currently actual permeability detection signal value detected by the permeability detection sensor 47 in each of the developers of the developing devices 4 of other colors (B, C, and D colors) is converted into the T/D ratio is considered. A value Sjc in which the currently actual permeability detection signal value detected by the permeability detection sensor 47 in each of the developers of the developing devices 4 of other colors (B, C, and D colors) at the time point when the T/D ratio of the A color reaches the lower limit Sjl is converted into the T/D ratio is also considered. The forced toner replenishing amounts necessary for the developing devices 4 of other colors (B, C, and D colors) is the necessary toner amount until the value Sjd reaches the value Sjc.

In Formula 3, ΔSj expresses a value in which a permeability signal value difference during the change in developer toner concentration by 1% is converted into the T/D ratio, and T expresses the toner amount for the developer toner concentration of 1%.

$$\text{necessary forced toner replenishing amount}=\{(Sjc-Sjd)/\Delta Sj\}\times T \quad \text{[Formula 3]}$$

In Formula 3, {(Sjc−Sjd)/ΔSj} indicates how many percent of the developer toner concentration is changed. The value Sjd in which the permeability detection signal value in each of other colors (B, C, and D colors) measured as needed is converted into the T/D ratio is considered. The value Sjc in which the currently actual permeability detection signal value detected by the permeability detection sensor 47 in each of the developers of the developing devices 4 of other colors (B, C, and D colors) at the time point when the T/D ratio of the A color reaches the lower limit Sjl is converted into the T/D ratio is also considered. {(Sjc−Sjd)/ΔSj} indicates that the difference between the value Sjd and the value Sjc is equivalent to how many percent of the developer toner concentration is changed.

{(Sjc−Sjd)/ΔSj} is multiplied by the toner amount T for the developer toner concentration of 1%. Therefore, sometimes the developer concentration sinks below the new lower limit Sjl (=Sjc), which is changed at the time point when the T/D ratio of the A color reaches the lower limit Sjl, of the T/D ratio of each of other colors (B, C, and D colors). In such cases, the necessary toner amount which should be replenished until the T/D ratio reaches the newly-set lower limit Sjl of the T/D ratio is calculated.

In Step S14, the currently-set lower limit Sjl of the T/D ratio is compared to the detected value Sjd. In the case of {Sjl>Sjd}, the currently-set lower limit Sjl of the T/D ratio is determined to sink below the previously-set lower limit Sjl of the T/D ratio, and the flow goes to Step S15 to forcedly replenish the toner by the toner amount calculated from Formula 3. Then the toner replenishing control is ended (Step S16).

In the case of {Sjl≤Sjd} in Step S14, the detected T/D ratio becomes greater than or equal to the previously-set lower limit Sjl of the T/D ratio, the toner concentration is determined to fall within the predetermined range, and the flow goes to Step S3. The control is performed through Steps S3 to S10 such that the patch image density becomes the initial density. When the developer toner concentration of the developing device of the A color returns into the predetermined range, the lower limit Sjl which is changed in Step 2 of the developer toner concentration in each of other colors (B, C, and D colors) is also returned to the initial value.

(The case that developer toner concentration of A color reaches upper limit) On the other hand, for the developing devices 4 of other colors (B, C, and D colors) which are not the developing device 4 of the color (A color) in which the T/D ratio (toner concentration) reaches the upper limit Sjh (exists outside the predetermined range) in Step S17, the flow goes to Step S18. The T/D ratios of other colors (B, C, and D colors), which are detected when the T/D ratio of the A color in which the T/D ratio reaches the upper limit Sjh reaches the upper limit Sjh, is changed as the new upper limit Sjh. The flow goes to Steps S3 to S10, and the control is performed such that the patch image density becomes the initial density.

For the developing device 4 of the A color in which the T/D ratio reaches the upper limit Sjh in Step S17, the flow goes to Step S19 to stop the toner replenishment. Then the toner replenishing control is ended (Step S20).

In the first embodiment, in the case of {Sjh≤Sjd} in Step S1, the currently actual developer toner concentration is determined to reach the upper limit Sjh of the T/D ratio of 12%.

In the case of {Sjh>Sjd} in Step S1, the developer toner concentration is determined to be below the upper limit Sjh of the T/D ratio of 12%.

In the case of {Sjl>Sjd} in Step S1, the currently actual developer toner concentration is determined to be below the lower limit Sjl of the T/D ratio of 6%.

On the other hand, in the case of {Sjl≤Sjd} in Step S1, the currently actual developer toner concentration is determined to be equal to or higher than the lower limit Sjl of the T/D ratio.

In the case of {Sjl<Sjd<Sjh} in Step S1, the T/D ratio of the developer toner concentration falls within the range between the lower limit Sjl of the T/D ratio of 6% and the upper limit Sjh of the T/D ratio of 12%. In this case, the flow goes to Steps S3 to S10, and the control is performed such that the patch image density becomes the initial density.

In the first embodiment, in the initial developer toner concentration, each color developer having the T/D ratio of 8% is used, the upper limit Sjh of the T/D ratio is set to 12%, and the lower limit Sjl of the T/D ratio is set to 6%. The initial density of the patch image is set to "0.8".

<Effect> Through the above control, the upper limit Sjh of the developer concentration in the developing device 4 (developing portion) of each of other colors (B, C, and D colors) in which the developer concentration does not reach the upper limit Sjh is changed as follows. That is, the upper limit Sjh of the developer concentration in the developing device 4 of each of other colors (B, C, and D colors) is changed to the developer concentration in the developing device 4 of each of other colors (B, C, and D colors) at the time point when the developer concentration in the developing device 4 of the A color in which the developer concentration reaches the upper limit Sjh. Therefore, the upper limit Sjh of the developer concentration in the developing device 4 of each of other colors (B, C, and D colors) in which the developer concentration does not reach the upper limit Sjh is newly adjusted downward to suppress the increase in developer concentration.

The lower limit Sjl of the developer concentration in the developing device 4 of each of other colors (B, C, and D colors) in which the developer concentration does not reach the previously-set lower limit Sjl is changed as follows. That is, the lower limit Sjl of the developer concentration in the developing device 4 of each of other colors (B, C, and D colors) is changed to the developer concentration in the developing device 4 of each of other colors (B, C, and D colors) at the time point when the developer concentration in the developing device 4 of the A color in which the developer concentration reaches the lower limit Sjl. Therefore, the lower limit Sjl of the developer concentration in the developing device 4 of each of other colors (B, C, and D colors) in which the developer concentration does not reach the lower limit Sjl is newly adjusted upward to suppress the decrease in developer concentration.

Accordingly, the image having the small change in shade can be formed in the composite color in which the plural color toners are superposed on one another.

At this point, the permeability detection sensor 47 is influenced by a bulk density of the developer. Therefore, sometimes the timing of calculating the necessary forced toner replenishing amount in Step S13 is ended. Sometimes the image formation is ended to end the rotation of the developing sleeve 40 of the developing device 4. In such cases, the timing when the permeability is detected while the developing sleeve 40 is rotated is provided during the post-rotation after the image formation.

For example, it is assumed that, in the A, B, C, and D colors, the T/D ratio of the A color reaches the lower limit Sjl of the A color while the T/D ratio of the B color reaches the upper limit Sjh of the B color. In this case, for the upper limit Sjh and lower limit Sjl of the T/D ratio of each of the A, B, C, and D colors, the T/D ratios of the B, C, and D colors at the time point when the T/D ratio of the A color reaches the lower limit Sjl of the A color are changed as the new lower limits Sjl of the B, C, and D colors. The T/D ratios of the A, C, and D colors at the time point when the T/D ratio of the B color reaches the upper limit Sjh of the B color are changed as the new upper limit Sjh of the A, C, and D colors.

Therefore, in the colors except the A color in which the T/D ratio reaches the lower limit Sjl, the T/D ratio of each color at the time point when the T/D ratio of the A color reaches the lower limit Sjl is adjusted upward to the lower limit Sjl of the T/D ratio of each color to suppress the decrease in developer concentration. In the colors except the B color in which the T/D ratio reaches the upper limit Sjh, the T/D ratio of each color at the time point when the T/D ratio of the B color reaches the upper limit Sjh is adjusted downward to the upper limit Sjh of the T/D ratio of each color to suppress the increase in developer concentration. Accordingly, the change in shade can be suppressed in the multiple order color made by the A color and the B, C, and D colors.

The material for the photosensitive drums 1Y, 1M, 1C, and 1Bk used in the image forming apparatus 100, the developer, and the configuration of the image forming apparatus 100 are not limited to those of the first embodiment, but the invention can be applied to various developer and image forming apparatuses. Specifically, the color of the toner or the number of toner colors, a procedure to develop each color toner, and the number of developing sleeves 40 that are of the developer bearing member are not limited to those of the first embodiment. The permeability detection sensor 47 is used as the developer concentration detecting portion. Alternatively, a conventional optical sensor may be used as the developer concentration detecting portion.

Figure 4:
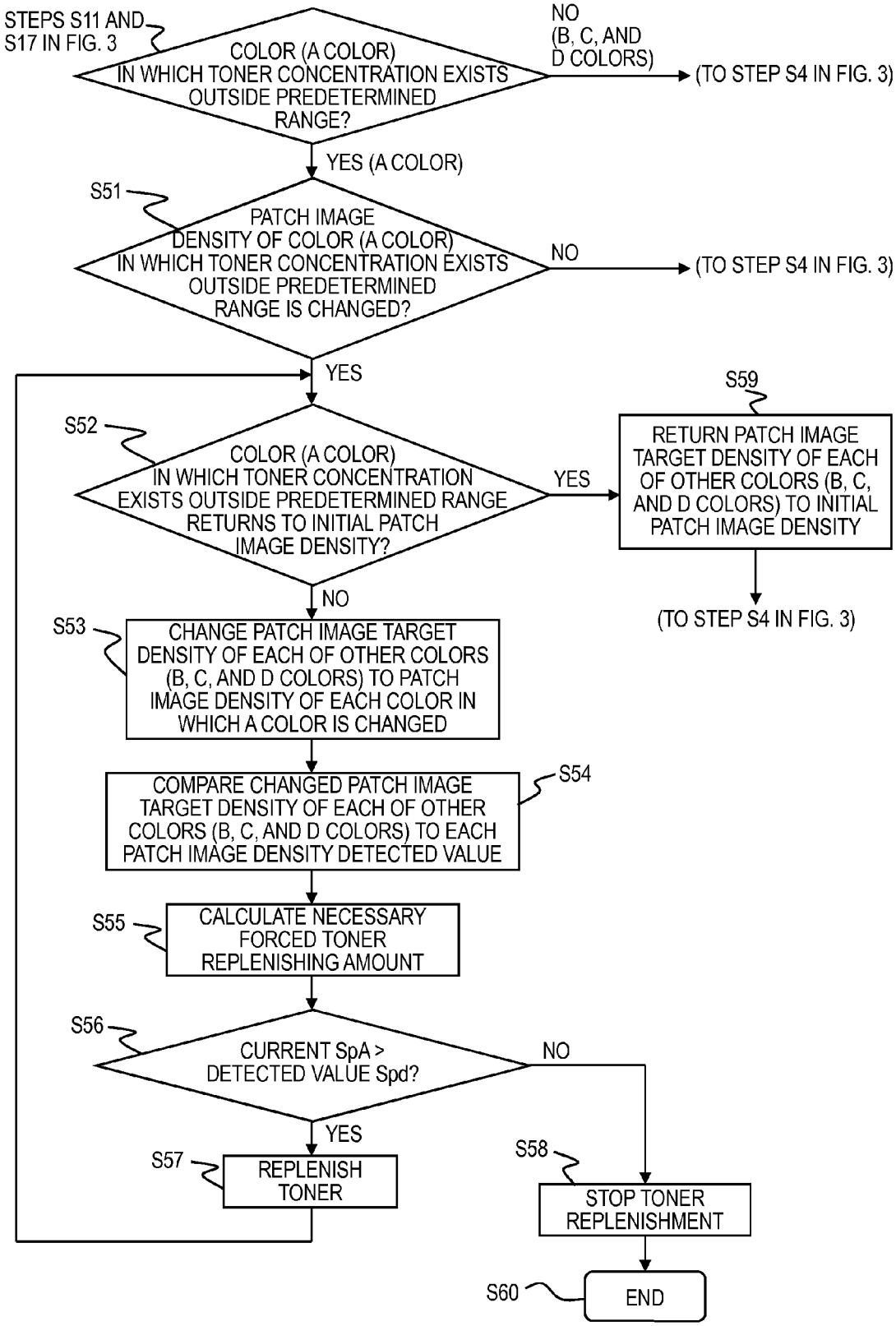
FIG. 4 is an example of a flowchart illustrating toner replenishing control in an image forming apparatus according to a second embodiment of the invention.

[Second Embodiment] A configuration of an image forming apparatus according to a second embodiment of the invention will be described with FIG. 4.

In the first embodiment, for example, when the developer concentration of the developing portion of the A color exceeds the upper and lower limits, the control is performed as follows. That is, the upper and lower limits of the developer concentration of each of other colors (B, C, and D colors) are changed to the developer concentration of each of other colors (B, C, and D colors) at the time point when the developer concentration of the A color exceeds the upper limit or the time point when the developer concentration of the A color sinks below the lower limit.

In the second embodiment, the developer concentration of the color (A color) to which the developer concentration constant control is performed deviates from a previously-set setting range to exist outside the predetermined range (outside setting range), and the image density of the color (A color) changes. At this point, the target image density of each of other colors (B, C, and D colors) is changed to the changed image density of the A color.

Based on the detection result of the permeability detection sensor 47, the CPU 11 which is of the controller controls the replenishing operation of the hopper 20 such that the developer concentration of the developing device 4 does not exceed a previously-set range. Additionally, based on the detection result of the toner adhesion amount detection sensor 46, the CPU 11 controls the replenishing operation of the hopper 20 such that the image density developed by the developing device 4 becomes a predetermined target image density.

Possibly the change in toner charge amount is generated during the developer toner concentration constant control. For example, a charge-up in which a toner charge amount further increases is generated during the constant control when the developer toner concentration reaches the upper limit Sjh of the T/D ratio, and the development characteristic is changed, thereby decreasing the toner adhesion amount (patch image density).

Similarly to the first embodiment, sometimes the developer toner concentration (developer concentration) of at least one of the plural developing devices 4 exists outside the predetermined range. In the second embodiment, the image density developed by the developing device 4 of the A color in which the developer toner concentration exists outside the predetermined range is changed, the image density is changed as the target image density of the developing device 4 of each of other colors (B, C, and D colors) in which the developer concentration falls within the predetermined range.

The second embodiment will specifically be described below with reference to FIG. 4. FIG. 4 illustrates a subroutine inserted between Steps S11 and S17 and Step S4 of the flowchart in FIG. 3.

When the developer toner concentration falls within the predetermined range in Step S1 of FIG. 3, the flow goes to the processing from Step S2, and the toner is replenished by the patch image density constant control.

The flow goes to Step S17 when the developer toner concentration reaches the upper limit Sjh in Step S1, and the flow goes to Step S11 when the developer toner concentration reaches the lower limit Sjl. When the color is not the color (A color) in which the developer toner concentration exists outside the predetermined range but other colors (B, C, and D colors) in Steps S11 and S17, the flow goes to Step S4 in FIG. 3 to perform the usual patch image density constant control. When the color is the color (A color) in which the developer toner concentration exists outside the predetermined range in Steps S11 and S17, whether the patch image density of the A color changes with respect to the previously-set initial patch image density (0.8) of the A color is determined in Step S51 of FIG. 4.

Unless the patch image density of the A color changes with respect to the initial patch image density, the flow goes to Step S4 in FIG. 3 to perform the usual patch image density constant control. On the other hand, when the patch image density of the A color changes with respect to the initial patch image density, the flow goes to Step S52 in FIG. 4. Whether the color (A color) in which the developer toner concentration exists outside the predetermined range returns to the initial patch image density (0.8) is determined in Step S52.

At the time point when the patch image density of the A color returns to the initial patch image density (0.8), the flow goes to Step S59 to return the patch image target density of each of other colors (B, C, and D colors) to the initial patch image density (0.8) of each other. Then the flow goes to Step S4 in FIG. 3 to perform the usual patch image density constant control.

Unless the patch image density of the A color returns to the initial patch image density (0.8) in Step S52, the flow goes to Step S53.

The patch image target density of each of other colors (B, C, and D colors) in which the developer toner concentration falls within the predetermined range is changed to the patch image density of each color at the time point when the image density developed by the developing device 4 of the A color in which the toner concentration exists outside the predetermined range changes.

The changed patch image target density of each of other colors (B, C, and D colors) and the currently actual patch image density detected value of each color are compared to each other in Step S54, and the necessary forced toner replenishing amount is calculated using Formula 4 in Step S55.

When the charge-up in which the toner charge amount further increases is generated in the color (A color) in which the toner concentration exists outside the predetermined range, the patch image density of the A color is detected by the toner adhesion amount detection sensor 46. For example, it is assumed that the patch image density of the A color decreases to 0.7 from 0.8 which is of the initial patch image density. At this point, the patch image target density of each of other colors (B, C, and D colors) is changed from 0.8 which is of the initial patch image density to 0.7 which is of the decreased patch image density of the A color.

In Formula 4, SpA is a patch image density detection signal value corresponding to the patch image density (0.7) of the A color when the patch image density of the A color changes with respect to the initial patch image density (0.8). Spd is the detection signal value of the patch image in the B color formed on the photosensitive drum 1 to the currently actual patch image density. ΔSp is the patch image density signal value difference during the change in developer toner concentration by 1%. T is the toner amount for the developer toner concentration of 1%.

$$\text{necessary forced toner replenishing amount} = \{(SpA - Spd)/\Delta Sp\} \times T \quad \text{[Formula 4]}$$

In Formula 4, {(SpA−Spd)/ΔSp} indicates how many percent of the developer toner concentration is changed. That is, {(SpA−Spd)/ΔSp} indicates that the difference between the patch image density detection signal value SpA of the A color and the patch image density detection signal value Spd of each of other colors (B, C, and D colors) is equivalent to how many percent of the developer toner concentration is changed when the patch image density of the A color changes with respect to the initial patch image density (0.8). The necessary toner amount to be replenished is calculated by multiplying {(SpA−Spd)/ΔSp} by the toner amount for the developer toner concentration of 1%.

In Step S56, the patch image density detection signal value SpA of the changed patch image target density is compared to the patch image density detection signal value Spd of each of other colors (B, C, and D colors). In the case of {SpA>Spd}, the currently actual patch image density of each of other colors (B, C, and D colors) is determined not to reach the changed patch image target density. The flow goes to Step S57 to replenish the toner replenishing amount calculated from Formula 4 to the developing device 4 from the hopper 20. Then the flow returns to Step S52.

In the case of {SpA≤Spd} in Step S56, the currently actual patch image density of each of other colors (B, C, and D colors) is determined to reach the changed patch image target density, or the currently actual patch image density of each of other colors (B, C, and D colors) is determined to exceed the patch image density of the A color in the change. The flow goes to Step S58 to stop the toner replenishment to the developing device 4. Then the flow is ended (Step S60).

The development characteristic of the A color is recovered, the developer toner concentration of the A color falls within the predetermined range, and the patch image density of the A color in which the developer toner concentration exists outside the setting range returns to the initial patch image density (initial image density) (0.8) (Step S52). At this point, the patch image target density of each of other colors (B, C, and D colors) is also returned to the initial patch image density (initial image density) (0.8) (Step S59). Then the flow goes to Step S4 in FIG. 3 to perform the usual patch image density constant control.

For example, in the case that the toner concentrations of at least two of the four colors exist outside the predetermined range, the patch image density is adjusted to the lowest patch image density in the two colors. Therefore, the toner charge amounts can substantially be equalized to one other to further decrease the change in shade.

It is considered that the toner concentration of one of the plural colors increases to exist outside the predetermined range, and that a charge-down in which the toner charge amount decreases is generated. Even in the case, the identical control can be performed by changing the patch image density target values of other colors to the patch image density of the color in which the developer toner concentration increases.

The material for the photosensitive drum 1 used in the image forming apparatus 100, the developer, and the configuration of the image forming apparatus 100 are not limited to those of the second embodiment, but the invention can be applied to various developer and image forming apparatuses. Specifically, the color of the toner or the number of toner colors, the procedure to develop each color toner, and the density data measuring position are not limited to those of the second embodiment.

In the second embodiment, the control is performed such that the developer toner concentration of only the A color falls within the predetermined range. For other colors (B, C, and D colors), the control is performed as follows. That is, when the toner image density of the A color in which the developer toner concentration exists outside the predetermined range changes, the control is performed such that the target toner image density of each of other colors (B, C, and D colors) in which the developer toner concentration falls within the predetermined range is changed to the changed toner image density of the A color.

Therefore, the development characteristic (that is, toner friction charge amount) of the A color can be matched with the development characteristic of each of other colors (B, C, and D colors) without changing other colors (B, C, and D colors) from the toner image density constant control to the developer toner concentration constant control. Accordingly, the image having the small change in shade can be formed in the composite color in which the plural color toners are superposed on one another.

[Third Embodiment ] In the second embodiment, the toner charge amounts on the photosensitive drums 1Y to 1Bk can substantially be equalized to one another. However, since the stabilization is performed in the state different from the initial toner charge amount, sometimes a fluctuation in shade caused by the degradation of the transfer efficiency is generated in the case of a certain level of change in toner charge amount. In a third embodiment, the change in toner charge amount is calculated by a simple method, and fed back to the transfer voltage applied to the primary transfer member 52, thereby suppressing the fluctuation in shade.

In the third embodiment, the CPU 11 is also used as a charge amount calculator. When the target toner adhesion amount on the patch image is changed, the CPU 11 calculates the change in toner charge amount of the developer from the change in toner adhesion amount detected by the toner adhesion amount detection sensor 46 which is of the image density detecting portion.

The CPU 11 is also used as the transfer voltage changing portion which changes the transfer voltage value applied to the primary transfer member 52 based on the calculation result. The transfer voltage changing portion changes the transfer voltage value applied to the primary transfer member 52 in order to transfer the toner from the photosensitive drum 1 to the intermediate transfer belt 51 which is of the transferred body.

Specifically, the change in toner charge amount is calculated as follows. A relationship among a charge amount (Q/s) charged by the developing toner on the photosensitive drum 1, the toner adhesion amount (mg/cm$^2$), and the toner charge amount (μC/g) is given by Formula 5.

$$Q/s = \text{toner adhesion amount} \times \text{toner charge amount} \quad (= \text{constant} \propto \text{developing contrast potential}) \qquad \text{[Formula 5]}$$

It is considered that the change in toner adhesion amount as the patch image density is considered to be the change in toner charge amount. It can be estimated that the toner charge amount is doubled when the toner adhesion amount becomes a half. Therefore, the transfer voltage value is set so as to decrease with increasing patch image density, and the transfer voltage value is set so as to increase with decreasing patch image density. The optimum transfer voltage value applied to the primary transfer member 52 with respect to the toner charge amount is stored in the CPU 11.

As to the charge amount per unit area of the post-development patch image, as indicated in Formula 5, a manufactured by the toner adhesion amount and the toner charge amount is kept constant. Therefore, in the equal developing contrast, the toner charge amount is determined to increase in the case that the toner adhesion amount detected by detecting the patch image density decreases. In this case, it is necessary to increase an optimum transfer current. This relationship can also be applied to the case that the toner adhesion amount increases.

As described above, the transfer current is increased (the transfer voltage is increased) in the case that the toner adhesion amount decreases (the patch image density decreases). On the other hand, the transfer current is decreased (the transfer voltage is decreased) in the case that the toner adhesion amount increases (the patch image density increases). Since the relationship between the toner charge amount and the optimum transfer current is unambiguously decided (including a process speed), a stable of the optimum transfer voltage value applied to the primary transfer member 52 to the toner charge amount is stored in the CPU 11 of the image forming apparatus 100 to be able to correspond to the relationship.

<Effect> Therefore, when the change in toner charge amount becomes a predetermined level or more by the change in toner adhesion amount, the transfer can efficiently be performed by feeding back the optimum transfer voltage (or the transfer current) as the transfer voltage value applied to the primary transfer member 52.

For example, in the case that the patch image density changes, the change in toner charge amount is calculated and fed back to the transfer voltage value applied to the primary transfer member 52, which allow the image forming apparatus 100 having the small change in shade to be provided with no trouble of the image.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-043236, filed Mar. 5, 2013, which is hereby incorporated by reference herein in its entirety.

What is claimed is:

1. An image forming apparatus comprising:

a first developing device which stores a first developer therein to develop a latent image;

a second developing device which stores a second developer therein to develop a latent image;

a first replenishing device which replenishes the developer to the first developing device;

a second replenishing device which replenishes the developer to the second developing device;

a first sensor which detects a concentration of the developer in the first developing device;

a second sensor which detects a concentration of the developer in the second developing device; and a controller which controls a replenishing operation of the first replenishing device based on the first sensor, and controls a replenishing operation of the second replenishing device based on the second sensor;

wherein the controller prohibits the replenishing operation of the first replenishing device when the developer concentration in the first replenishing device reaches a first upper limit set to the first developing device;

wherein the controller prohibits the replenishing operation of the second replenishing device when the developer concentration in the second replenishing device reaches a second upper limit set to the second developing device; and wherein the controller corrects the second upper limit based on the developer concentration in the second developing device when the developer concentration in the first developing device reaches the first upper limit.

2. The image forming apparatus according to claim 1, wherein the controller returns the second upper limit to a pre-correction second upper limit, when the developer concentration of the first developing device falls below the first upper limit after the second upper limit is corrected.

3. An image forming apparatus comprising:

a first developing device which stores a first developer therein to develop a latent image;

a second developing device which stores a second developer therein to develop a latent image;

a first replenishing device which replenishes the developer to the first developing device;

a second replenishing device which replenishes the developer to the second developing device;

a first sensor which detects a concentration of the developer in the first developing device;

a second sensor which detects a concentration of the developer in the second developing device; and a controller which controls a replenishing operation of the first replenishing device based on the first sensor, and controls a replenishing operation of the second replenishing device based on the second sensor;

wherein the controller forcedly performs the replenishing operation from the first replenishing device to the first developing device when the developer concentration in the first developing device reaches a first lower limit set to the first developing device;

wherein the controller forcedly performs the replenishing operation from the second replenishing device to the second developing device when the developer concentration in the second developing device reaches a second lower limit set to the second developing device; and wherein the controller corrects the second lower limit based on the developer concentration in the second developing device when the developer concentration in the first developing device reaches the first lower limit.

4. The image forming apparatus according to claim 3, wherein the controller returns the second lower limit to a pre-correction second lower limit, when the developer concentration of the first developing device exceeds the first upper limit after the second lower limit is corrected.

5. An image forming apparatus comprising:

a plurality of developing devices which store developers having different colors therein to develop a latent image;

a plurality of replenishing devices which replenish the developers to the developing devices;

a plurality of sensors which detects concentrations of the developers in the developing devices; and a controller which controls a replenishing operation of each replenishing device;

wherein, when the developer concentrations in the developing devices reach upper limits each of which is set to each developing device based on a detection result of each sensor, the controller prohibits the replenishing operation to the developing device in which the developer concentration reaches the upper limit; and wherein, when the developer concentration in one of the developing devices reaches the upper limit, the controller corrects the upper limit of the remaining developing device based on the developer concentration in the remaining developing device.

6. The image forming apparatus according to claim 5, wherein the controller returns the upper limit of the remaining developing device to a pre-correction upper limit when the developer concentration of one of the first developing devices falls below the previously-set upper limit after the upper limit of the developing device is corrected.

7. An image forming apparatus comprising:

a plurality of developing devices which store developers having different colors therein to develop a latent image;

a plurality of replenishing devices which replenish the developers to the developing devices;

a plurality of sensors which detects concentrations of the developers in the developing devices; and a controller which controls a replenishing operation of each replenishing device;

wherein, when the developer concentrations in the developing devices reach lower limits each of which is set to each developing device based on a detection result of each sensor, the controller forcedly performs the replenishing operation such that the developing device in which the developer concentration reaches the lower limit does not fall below the lower limit; and wherein, when the developer concentration in one of the developing devices reaches the lower limit, the controller corrects the lower limit of the remaining developing device based on the developer concentration in the remaining developing device.

8. The image forming apparatus according to claim 7, wherein the controller returns the lower limit of the remaining developing device to a pre-correction lower limit, when the developer concentration of one of the developing device exceeds the previously-set lower limit after the lower limit of the remaining developing device is corrected.

* * * * *